US011781830B2

(12) United States Patent
Carlston

(10) Patent No.: US 11,781,830 B2
(45) **Date of Patent: *Oct. 10, 2023**

(54) PROTECTIVE GLOVE FOR ARCHERY SHOOTING

(71) Applicant: Shooting Edge Technology, LLC, Lehi, UT (US)

(72) Inventor: Marvin Carlston, Lehi, UT (US)

(73) Assignee: Shooting Edge Technology, LLC, Lehi, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/618,654

(22) Filed: Jun. 9, 2017

(65) Prior Publication Data

US 2017/0336167 A1 Nov. 23, 2017

Related U.S. Application Data

(63) Continuation of application No. 13/252,022, filed on Oct. 3, 2011, now Pat. No. 9,677,842.

(60) Provisional application No. 61/140,312, filed on Oct. 1, 2010.

(51) Int. Cl.
*F41B 5/14* (2006.01)
*A63B 71/14* (2006.01)

(52) U.S. Cl.
CPC ..... *F41B 5/148* (2013.01); *A63B 71/14* (2013.01); *A63B 2209/00* (2013.01); *A63B 2244/04* (2013.01); *F41B 5/1473* (2013.01); *F41B 5/1476* (2013.01)

(58) Field of Classification Search
CPC ..... F41B 5/148; F41B 5/1476; F41B 5/1473; A63B 71/14; A63B 2244/04
See application file for complete search history.

(56) References Cited

U.S. PATENT DOCUMENTS 2,555,203 A * 5/1951 Ramsey ..... F41B 5/1473 124/23.1
2,907,047 A 10/1959 Steinberg
D243,133 S 1/1977 Lowrey
(Continued)

OTHER PUBLICATIONS

Magid Glove 1 Ergonomic Products 1 Ergonomic Gloves 1 Magid® ATV202 Fingerless Gel Palm Padded Impact Glove, posted on Sep. 27, 2009, © 2016 [online], [site visited Aug. 25, 2016]. Available from Internet, <URL: https://www.magidglove.com/Magid-ATV202-Blue-Fingerless-AntiVibration-Gloves-with-Leather-Palm-Patch-1-A TV202LHOS.aspx/>.

*Primary Examiner* — Khaled Annis
(74) *Attorney, Agent, or Firm* — Thorpe North & Western, LLP; Peter M. de Jonge; Kurt Hendricks

(57) ABSTRACT

There is provided a protective glove to cover at least a portion of a hand of an archer during the shooting of arrows from a bow, which glove is designed to resist a broken arrow from puncturing through the glove and entering the flesh of the user. In particular, there may be a palm section, made of a first arrow puncturable material that covers the palm of the users hand. There may also be a protective section, located on the glove covering the back of the hand of the user, made of a second material that has a high weight-to-strength value, coupled to the palm section and positioned so that a broken arrow being shot from a bow will have a higher likely hood of hitting the protective section than hitting areas not having the protective section.

8 Claims, 7 Drawing Sheets

(56) References Cited

U.S. PATENT DOCUMENTS 4,004,295 A 1/1977 Byrnes, Sr.
4,067,063 A * 1/1978 Ettinger ..... A42B 3/121 2/413
4,384,449 A 5/1983 Byrnes, Sr. et al.
4,416,026 A * 11/1983 Smith ..... A41D 19/0013 2/161.6
4,701,963 A 10/1987 Overton
4,958,384 A 9/1990 McCrane
D347,100 S 5/1994 Greene
5,407,612 A * 4/1995 Gould ..... B29C 41/14 2/2.5
D372,578 S 8/1996 Chapman
5,568,657 A 10/1996 Cordova et al.
5,581,809 A 12/1996 Mah
5,601,895 A * 2/1997 Cunningham ..... A41D 31/0061 128/878
5,640,712 A * 6/1997 Hansen ..... A41D 19/01523 2/16
5,829,057 A * 11/1998 Gunn ..... A41B 11/00 2/115
5,898,938 A * 5/1999 Baylor ..... A41D 19/01523 2/161.1
D437,461 S 2/2001 Caswell
D442,745 S 5/2001 Minkow et al.
6,226,795 B1 * 5/2001 Winningham ..... A41D 13/084 2/20
6,272,687 B1 8/2001 Cunningham
6,457,182 B1 * 10/2002 Szczesuil ..... A41D 19/01511 2/16
6,760,924 B2 * 7/2004 Hatch ..... A41D 19/01558 2/161.5
7,007,308 B1 3/2006 Howland et al.
7,043,770 B1 5/2006 Cunningham
7,086,093 B2 * 8/2006 Carey ..... A41D 19/01529 2/159
D527,850 S 9/2006 Mangee et al.
D577,830 S 9/2008 King
2004/0064865 A1 4/2004 Hummel
2005/0076418 A1 * 4/2005 von Blucher ..... A41D 19/015 2/161.6
2006/0075539 A1 4/2006 Anderson et al.
2007/0113317 A1 * 5/2007 Garneau ..... A41D 19/01523 2/161.1
2008/0183116 A1 7/2008 Platt
2008/0289087 A1 * 11/2008 Sundnes ..... A41D 31/0061 2/456
2009/0070916 A1 * 3/2009 Kassam ..... A41D 19/01505 2/158
2009/0100573 A1 * 4/2009 Coulter ..... A41D 19/01582 2/161.1
2009/0126058 A1 * 5/2009 Loos ..... A41D 19/01505 2/2.5
2009/0229035 A1 * 9/2009 Van Hale ..... A41D 19/002 2/161.6
2009/0276933 A1 * 11/2009 Dodd ..... A41D 13/0153 2/16
2010/0223710 A1 9/2010 Bell
2011/0289643 A1 12/2011 Mazzarolo
2012/0131715 A1 * 5/2012 Copeland ..... A63B 71/143 2/16

* cited by examiner

PROTECTIVE GLOVE FOR ARCHERY SHOOTING

CLAIM OF PRIORITY

This application is a continuation of and claims priority to U.S. patent application Ser. No. 13/252,022 filed on Oct. 3, 2011 entitled "Protective Glove for Archery Shooting" which is incorporated herein in its entirety which claims priority, under 35 U.S.C. § 120, to U.S. Provisional Patent 61/404,312, entitled "Archery Hand Guard" which is also incorporated by reference herein.

FIELD OF THE INVENTION

The present invention relates to a protective glove for archery shooting, and more specifically, to a glove that has a back portion designed to resist the impact of a broken arrow, for example.

DESCRIPTION OF THE RELATED ART

In the related art of archery, it has been known to use gloves in the assistance of shooting arrows from a bow in the sport known as archery. Specifically, there are hundreds of injuries per year where the archer, or user, has their hand pierced by a broken arrow shaft, or an arrow that is too short for the bow, for example. These accidents often permanently cripple the archer for life. This accident often occurs because the arrows are made of fiber, fiber glass, or other composite materials, and even metal arrows. Thus, when an arrow is pulled back, in the traditional posture, the shaft of the arrow may become lodged, wedged, jammed or held between the arrow rest on the bow, and the bow riser. If this occurs the bound arrow can buckle and break because of the energy of the drawn bow. Under these circumstances, the arrow can split into dozens of long splinters that are then projected into the back side of the hand holding the bow. The known prior art of archery gloves provide no known protection from such splintering.

Examples of references related to the present invention, but not teaching alone or in combination the present invention, are described below, and the supporting teachings of each reference are incorporated by reference herein:

U.S. Patent/Publication No. 4,004,295, issued Jan. 25, 1977 to Byrnes, Sr., entitled "PROTECTIVE GLOVE CONSTRUCTED OF FLEXIBLE STRANDS OF METAL WIRE AND FIBER YARN" discloses a protective glove for use by persons engaged in various operations in meat packing or processing plants such as an operator who uses a knife during various meat cutting procedures in which one hand usually holds the knife and manipulates it adjacent the other hand or other portions of the body which frequently results in accidental injury. The glove is constructed from a flexible fiber and a small wire fiber combined in a conventional manner of constructing gloves with the non-metallic fiber preferably being an aramid fiber having unique properties advantageously employed in such articles of manufacture with the fiber being manufactured by the DuPont Company of Wilmington, Del., under the trademark "Kevlar." The metallic wire fiber or strands are flexible, quite strong and materially strengthens the glove and renders it more durable and aids in preventing penetration of the glove by a knife blade or the like. The glove is of light-weight construction and may be provided with various wrist lengths and without straps or buckles thereby eliminating failure of such items and the tendency of such items to catch on various machines and the like.

U.S. Patent/Publication No. 4,384,449, issued May 24, 1983 to BYRNES, SR., ET AL., entitled "PROTECTIVE GLOVES AND THE LIKE AND A YARN WITH FLEXIBLE CORE WRAPPED WITH ARAMID FIBER" discloses Protective gloves and the like and a yarn comprising a core of a flexible wire alongside an aramid fiber strand or strands and a covering of aramid fiber such as that manufactured and sold under the trademark "Kevlar" by the DuPont Company of Wilmington, Del. in which the aramid fiber is either spun or filament. Two aramid fiber strands, either spun or filament, are wrapped around the core with one strand wrapped in a clockwise direction and the other strand wrapped in a counter-clockwise direction with the opposite spiral wrapping of the strands serving to secure the strands in position on the core without any other securing means. The yam having a flexible core with aramid fiber strands wrapped thereon is used to make protective gloves on conventional glove knitting or weaving machinery and is capable of movement in relation to needle eyes and the like without jamming in the same manner as various natural and synthetic fiber yams. The yam having a flexible core with aramid fiber strands wrapped thereon is also used in making various other products normally made of conventional fiber yam.

U.S. Patent/Publication No. 5,568,657, issued Oct. 29, 1996 to Cordova, et al., entitled "CUT RESISTANT PROTECTIVE GLOVE" discloses a flexible, uncoated glove made from nonmetallic fabric comprising at least one fiber is disclosed. The glove is characterized by either weighing no more than about 30 g or having a thickness of no more than about 1.25 mm (0.05 inch), being cut resistant over some portion thereof by enduring without cutting through at least 5 cycles of an impact cam cut test, having compliance so that the wearer has a high degree of tactility, and having a cut resistance of at least 5 cycles of an impact cam cut test after a disinfectant treatment with sodium hypochlorite. The gloves are particularly useful in the medical field where they provide excellent cut protection and can be disinfected at least once while maintaining an acceptable level of cut resistance. In an alternate embodiment, a similarly characterized glove is made from a layer of fibrous material adhered to a surface of an elastomeric glove without being fully encapsulated thereby. This glove is also particularly useful in the medical field where it provides excellent cut protection.

U.S. Patent/Publication No. 6,272,687, issued Aug. 14, 2001 to Cunningham, entitled "PUNCTURE PROOF SURGICAL GLOVES" discloses a puncture proof surgical glove and methods for producing the puncture proof glove are provided. The puncture proof glove provides flexibility and elasticity and protects against dangerous puncture wounds from needles and scalpels. The puncture proof surgical glove includes a first glove and second glove that each include a first pattern cut from a first material in a shape, a first layered stack of a plurality of patterned sheets, each of the plurality of patterned sheets cut from a second material in the first shape and having multiple line cuts through the second material, a second pattern cut from the first material in the first shape, and a third pattern cut in the first shape. The first pattern is layered on top of the first layered stack and the second pattern is layered on the bottom of the first layered stack and the first pattern and second pattern are bonded along their edges. The third pattern is then bonded to the edge of the bonded first and second patterns along an edge of the third pattern except for a portion of the edge to provide for an opening. The second glove is placed over the first glove so that the third pattern of the second glove is layered on top of the first pattern, and the bonded edge of the second glove overlaps the bonded edge of the first glove. Then the third pattern of the second glove is bonded to the first pattern of the first glove.

U.S. Patent/Publication No. 7,007,308, issued Mar. 7, 2006 to Howland, et al., entitled "PROTECTIVE GARMENT AND GLOVE CONSTRUCTION AND METHOD FOR MAKING SAME" discloses a system of manufacturing to incorporate protective materials with high cut and puncture resistance into standard safety and apparel products including gloves, to create a highly effective and low cost system of producing safety garments while preserving the characteristics of the original garment. This includes attaching a cut and puncture resistant protective liner or multiple liners to the inside or outside of or within a garment such as a glove by means of adhesives or stitching. The liner may be a protective liner with cut resistance greater than 450 lbs per inch/thickness and/or puncture resistance greater than 50 lbs per inch/thickness depending on the application requirement for protection and dexterity.

U.S. Patent/Publication No. 7,043,770, issued May 16, 2006 to Cunningham, entitled "PUNCTURE AND CUT RESISTANT SURGICAL GLOVE WITH MACROSPHERE CAPTURE DEVICES" discloses a puncture and cut resistant surgical glove is provided for protection against injury from sharp surgical instruments and needles. The puncture and cut resistant surgical glove includes overlaid arrays of adjacent substantially spherical macrospheres. Each macrosphere has capture devices for capturing the point of a sharp instrument. An elastomer encapsulates the overlaid arrays of adjacent macrospheres. Each macrosphere is either porous or formed of smaller microspheres that are aggregated together to provide capture devices. A polymer is coated over the aggregated microspheres to give each macrosphere a smooth surface. The polymer and microspheres provide a capture function for capturing the points of sharp instruments. The puncture and cut resistant surgical glove can be fabricated using low cost manufacturing methods.

U.S. Patent/Publication No. 20040064865, filed Apr. 8, 200 by Hummel, Joseph, entitled "CUT RESISTANT FABRIC AND GLOVE" discloses a cut-resistant fabric for use in protective apparel that provides cut resistance with relative comfort and low cost. The fabric is knitted from a first end of composite yam and second and third ends of spun fiber machine-knitted together three-ends-in. The first, second, and third ends are randomly placed within the cut-resistant fabric. The first end is a cut-resistant composite yam having a cut resistant core wrapped in a plurality of strands of cut resistant material and the second and third ends is a spun fiber. A colored thread is disposed within the cut resistant composite yam along the cut resistant core to provide a visible indication of wear on the strands of cut resistant material.

U.S. Patent/Publication No. 20060075539, filed Apr. 13, 2006 to Anderson; Douglas D.; et al., entitled "MITT" discloses an improved mitt for cold weather use is configured to provide a variety of modes of wear. The mitt is convertible between a fully closed position for covering the hand and fingers and open positions for exposure of the thumb and/or finger(s) or the entire hand. An internal pocket within the mitt permits continuous or intermittent warming of all or some of the fingers when the mitt is in either a generally open position or closed position. Insertion and removal of fingers and thumb relative the internal pocket is easily accomplished without use of the other hand. A thumb hole and/or finger hole for thumb/finger exposure is formed with an overlapping two-layer seal of stretchable material to prevent heat loss while ensuring easy thumb/finger insertion and removal. In one embodiment, stretchable fillets connect the terminal ends of the palm side and back side of the mitt to provide a snug fit about the wrist. The wearing modes include full exposure of a hand, exposure of the thumb and/or a finger(s), exposure of the four finger tips, and full hand coverage.

U.S. Patent/Publication No. 20100223710, filed Sep. 9, 2010 by Bell; Mark Wylie, entitled "ARCHER'S FINGER PROTECTION DEVICE" discloses a finger-protection device for archery with a single stall surrounding a plurality of fingers on the same side of the arrow nock, and a stall surrounding a single finger, or a plurality of contiguous fingers on the opposite side of the nock as may be applicable to an archer's style of grip.

What is needed is a protective glove that is especially designed to protect the back of an archers bow holding hand from being pierced from a broken arrow shaft or splinters, for example. Additionally, there is a need for an archer glove to be made of a material that can withstand the impact of such an arrow misfire. Also, there is a need for the protective material to be flexible and inexpensive. Additionally, there is a need for a device that solves one or more of the problems described herein and/or one or more problems that may come to the attention of one skilled in the art upon becoming familiar with the current specification and appended drawings.

SUMMARY OF THE INVENTION

The present invention has been developed in response to the present state of the art, and in particular, in response to the problems and needs in the art that have not yet been fully solved by currently available template systems. Accordingly, the present invention has been developed to provide protection to the hand of an archer from a broken arrow that may puncture the hand of a user.

While the device and methods described in the present invention have proven to be particularly useful in the area of archery, those skilled in the art can appreciate that the device and methods can be used in a variety of different applications and in a variety of archer hand protection.

In particular there is provide a protective glove to cover at least a portion of a hand of an archer during the shooting of arrows from a bow, which glove is designed to resist a broken arrow from puncturing through the glove and entering the flesh of the user, comprising: a palm section, made of a first arrow puncturable material that covers the palm of the users hand; and a protective section, located on the glove covering the back of the hand of the user, made of a second material that has a weight-to-strength value of at least that of steel, coupled to the palm section and positioned so that a broken arrow being shot from a bow will have a higher likely hood of hitting the protective section than hitting areas not having the protective section.

Another embodiment of the invention may include a protective glove where the second material is a Para-Aramid synthetic fiber, or a Poly-Paraphenylene Terephthalamide material. Wherein the second material may be a material selected from the group consisting of steel, ceramic, and impact resistant plastics.

Yet a further embodiment of the invention may be to have the fingers of the hand of an archer to be covered.

A further embodiment of the invention may be to have the first material being selected from the group consisting of leather, cotton, nylon, polymers, and silk.

Another embodiment of the invention may be to have the protective section consisting of a first layer of Para-Aramid synthetic fiber, a second layer made of an energy absorbing material.

A variation of the embodiment of the invention may be to have the protective section consisting of a first layer of Para-Aramid synthetic fiber, a second layer made of an energy absorbing material, a third layer made of the same para-aramid synthetic fiber, and a forth layer made of the same energy absorbing material layer.

The protective glove of claim 1, wherein the protective section is sewn to the first material.

These and other objects of the present invention will become readily apparent upon further review of the following specification and drawings.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced with one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Similar reference numbers denote corresponding features consistently throughout the attached drawings. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
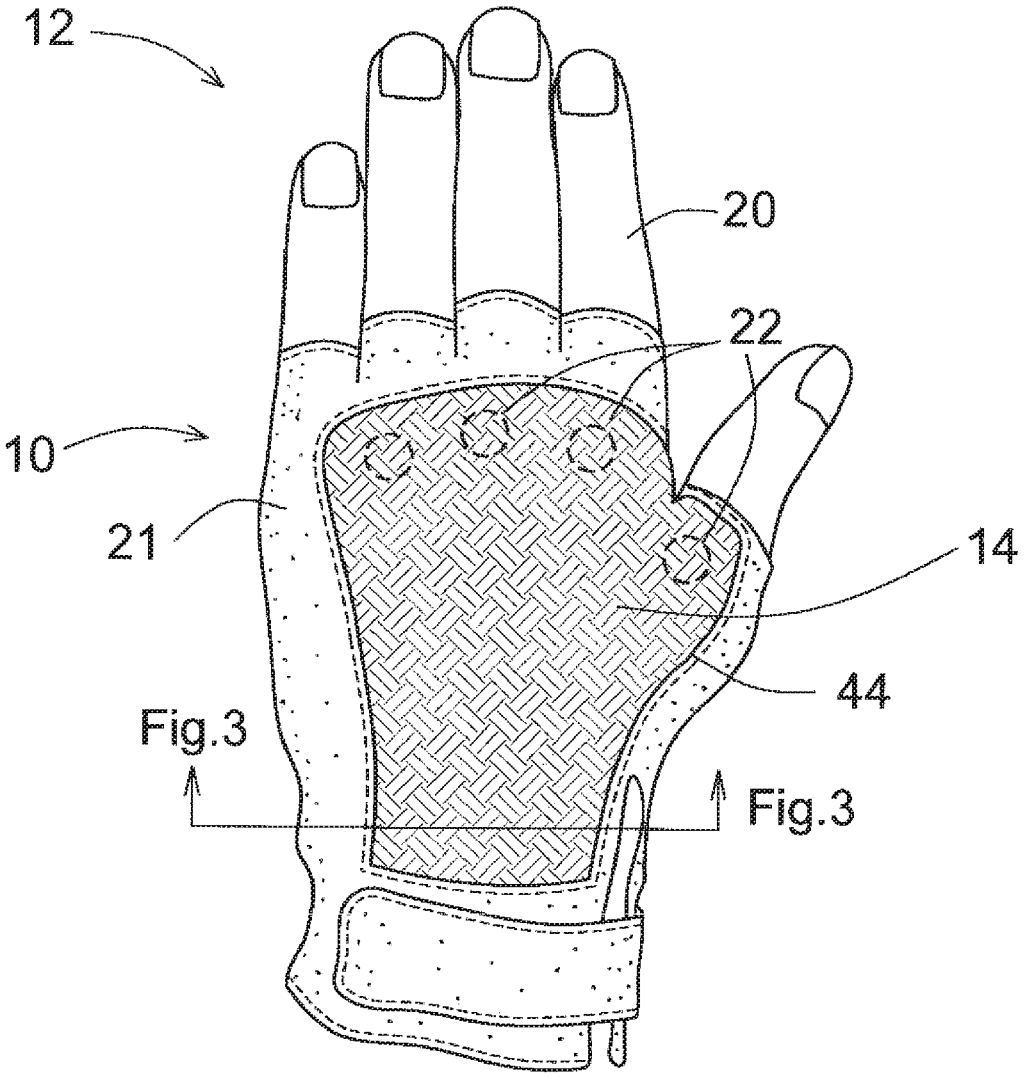
FIG. 1 is a perspective view of a person wearing a protective glove for archery shooting, according to one embodiment of the present illustrated invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

The basis of the present invention is built around the idea of protecting the hand of an archer from accidental damage due to known prior injuries typically caused by an arrow, or portions thereof, being forced into the back of the archers hand.

As used herein, reference is made to the "hand" of a user. By definition, it is intended that the hand includes several individual parts, such as the palm, fingers, thumb, knuckles, sides of fingers and other known named parts all the way to the writs region.

Regarding FIG. 1, there is illustrated an isometric view of one embodiment of a back side of the protective glove 10. Specifically, a users hand 12 is placed into the glove 10 in a known fashion, where the fingers 20 of the user may extend from the glove in one embodiment. There is illustrated a protective patch 14 attached to the back side of the glove 10 in the location of back side of the hand. The protective patch 14 is coupled to regular material 21 used in making the remainder of the glove 10. For explanation purposes, knuckles 22 of a users hand are illustrated where they fit under the protective patch. It is noted that there are only four knuckles indicated in this embodiment. The patch may be sewn to the glove via stitching 44.

It is noted, in another embodiment, that the protective patch 14 may be placed to cover the entire back side of the glove and all knuckles. The protective patch may even be placed to cover the sides of the hand. It is not intended to have the protective patch to cover the front side of the hand, or the palm area.

Figure 2:
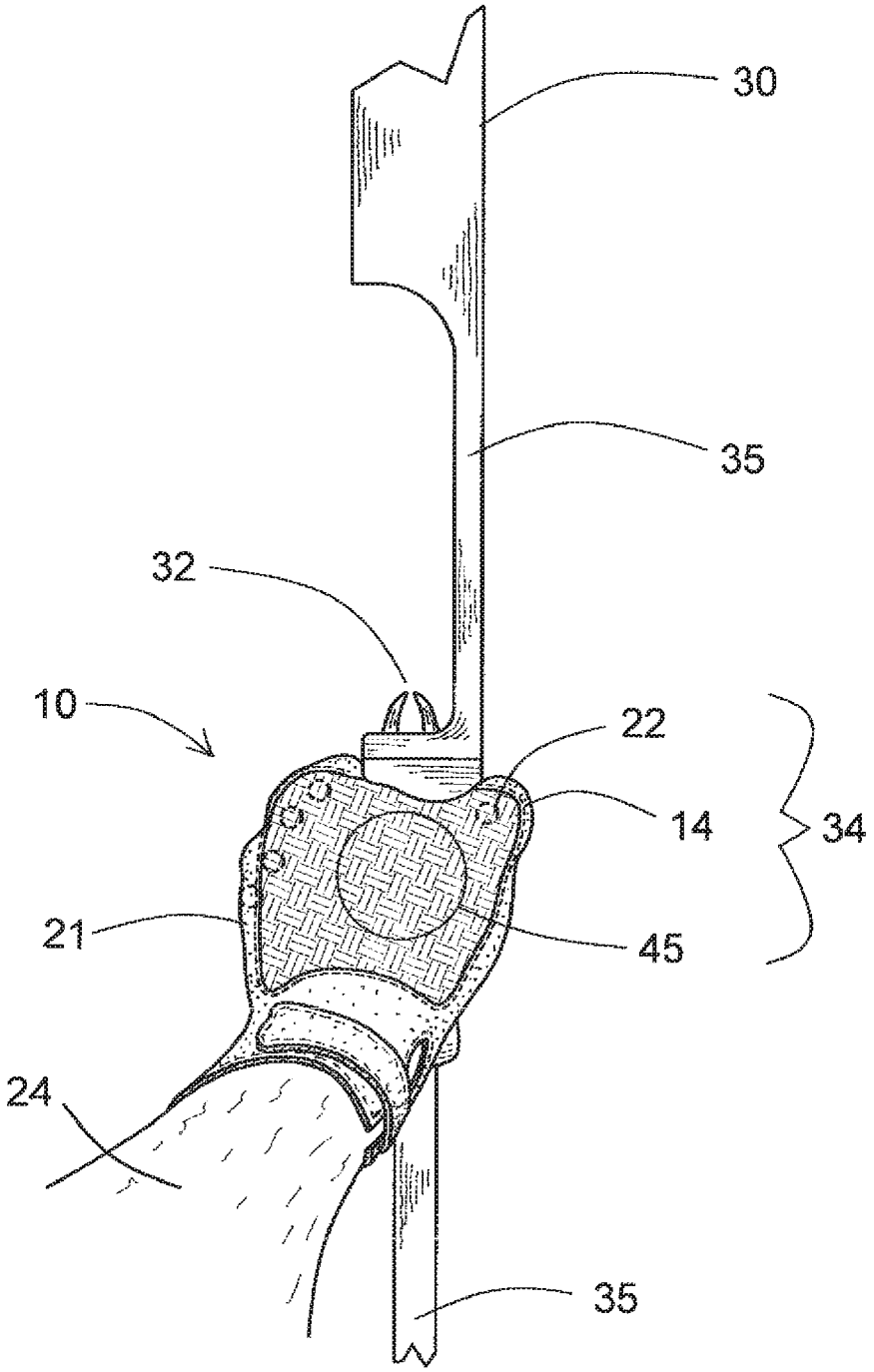
FIG. 2 is a perspective of a user holding a bow while wearing a protective glove for archery shooting, according to one embodiment of the present illustrated invention.

Referring now to FIG. 2, there is illustrated the use of the protective archery glove while a user is holding a bow 30. In particular, the bow 30 includes an arrow rest 32, a bow riser 35, and a bow hand grip area 34 (not shown since it is located under the glove of the user in this FIG. 2). The arm 24 of the user will extend downward and away from the glove 10. There is illustrated a high impact area 45 on the glove 10, which is the area that is most likely to be impacted by an arrow or portion thereof in an accident of the type described herein. In one aspect of the technology, the high impact area 45 corresponds to the purlicue portion of the glove.

It is noted that when a user is wearing the illustrated archer protective glove during the time that the archer is using the bow, all of the area where the highest probability of being hit by an arrow is completely covered, and a large area around the high impact area is covered.

Figure 3:
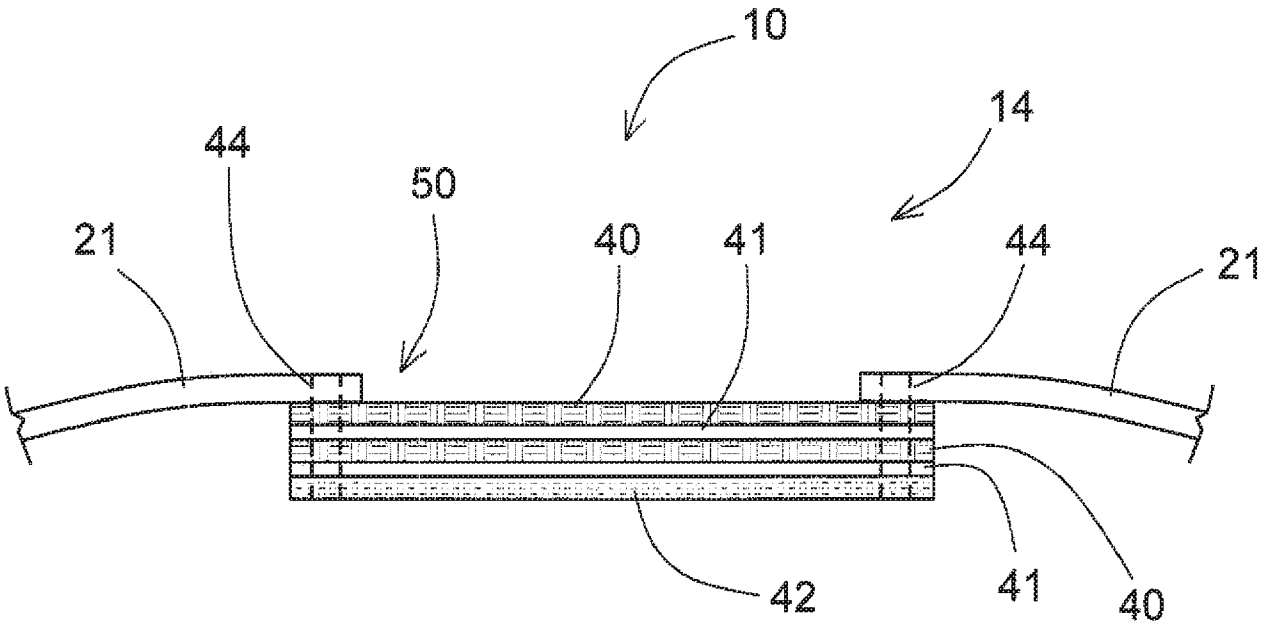
FIG. 3 is a side sectional view showing an embodiment of a section of a protective portion of a protective glove for archery shooting, according to an embodiment of the present illustrated invention.

Referring now to FIG. 3, there is illustrated, in one embodiment, a sectional side view of the area of the glove containing the protective patch 40. In particular, in this embodiment, the first or standard glove material 21 has a void area 50, where no standard material is located. Coupled to the edges of the standard glove material 21 is a layer of puncture resistant material. Typical puncture resistant material may be selected from the group consisting of Kevlar®, bullet proof vest material, a woven material, a sheet of bullet proof plastic, metal sheet, metal scale, high strength fibers, or any other known or yet to be developed material that would prevent an arrow from puncturing there through. The next layer, located below the first puncture resistant material 40 is an energy absorbing layer of material. This energy absorbing layer is designed to dissipate the impact energy known to occur upon impact of an arrow to the illustrated area of the hand. Typical materials that may be applicable may be polymers, polyesters, rubbers, foams, ceramics, fibers, or any other known or yet to be developed materials. There is also illustrated, in an additional embodiment, a second layer of puncture resistant material 40 and a second layer of energy absorbing material 41 located thereunder.

Whatever the number of layers of puncture resistant and energy absorbing materials, there is placed a softer skin compatible material 42 to enable a user to place their hand against that portion of the glove without encountering unusual abrasion or other non-glove feel. All of the layers are designed to be stitched to the standard glove material 21 with known stitching 44 sewing thread and the like.

It is noted that standard gloves are made of regular materials, such as leather, cotton cloth, nylon, etc. These materials have been used for several reasons. First of all, there is a need for flexibility to conform to the movements of the palm and the fingers. These prior known and used materials are very flexible. Additionally, the regular materials need to be inexpensive. Leather, cloth, nylon, cotton, etc. are very inexpensive materials. The design of the currently illustrated invention, is in part, due to these flexible and inexpensive criteria. Wherein, known protective materials, are much stiffer, and more expensive than regular materials used in making gloves. Thus, the protective patch 14 is best place only near the place where there is little or no flexation taking place during the use of the archers bow, i.e. the back area of the hand. This placement allows for the least expensive design, which is already more expensive than a glove that does not have the protective patch. This placement also is located in the position that has much less flexible requirements than the palm of the hand.

It is noted that Kevlar is the registered trademark for a para-aramid synthetic fiber, related to other aramids such as Nomex and Technora. Kevlar was developed at DuPont in 1965. This high strength material was first commercially used in the early 1970's as a replacement for steel in racing tires. Typically it is spun into ropes or fabric woven sheets that can be used as such or as an ingredient in composite material components. Currently, Kevlar has many applications, ranging from bicycle tires and racing sails to body armor because of its high tensile strength-to-weight ratio. The strength to weight ration measure is 5 times stronger than steel on an equal weight basis. A similar fiber called Twaron with roughly the same chemical structure was developed by Akzo in the 1970's; commercial production started in 1986, and Twaron is now manufactured by Teijin.

Poly-paraphenylene terephthalamide—branded Kevlar—was invented by Stephanie Kwolek while working for DuPont. In anticipation of a gasoline shortage, in 1964 her group began searching for a new lightweight strong fiber to use for light but strong tires. The polymers she had been working with at the time, poly-p-Phenylene-terephthalate and polybenzamide, formed liquid crystal while in solution, something unique to those polymers at the time. The solution was "cloudy, opalescent upon being stirred, and of low viscosity" and usually was thrown away. However, Kwole persuaded the technician, Charles Smullen, who ran the "spinneret", to test her solution, and was amazed to find that the fiber did not break, unlike nylon. Her supervisor and her laboratory director understood the significance of her discovery and a new field of polymer chemistry quickly arose. By 1971, modem Kevlar was introduced. However, Kwolek was not very involved in developing the applications of Kevlar.

Kevlar is synthesized in solution from the monomers 1,4-phenylene-diamine (para-phenylenediamine) and terephthaloyl chloride in a condensation reaction yielding hydrochloric acid as a byproduct. The result has liquid-crystalline behavior, and mechanical drawing orients the polymer chains in the fiber's direction. Hexamethylphosphoramide (HMPA) was the solvent initially used for the polymerization, but for safety reasons, DuPont replaced it by a solution of N-methyl-pyrrolidone and calcium chloride. Kevlar (poly paraphenylene terephthalamide) production is expensive because of the difficulties arising from using concentrated sulfuric acid, needed to keep the water-insoluble polymer in solution during its synthesis and spinning.

Several grades of Kevlar are available:

1. Kevlar K-29—in industrial applications, such as cables, asbestos replacement, brake linings, and body/vehicle armor.
2. Kevlar K49—high modulus used in cable and rope products.
3. Kevlar K100—colored version of Kevlar
4. Kevlar K119—higher-elongation, flexible and more fatigue resistant.
5. Kevlar K129—higher tenacity for ballistic applications.
6. Kevlar AP—has 15% higher tenacity than K-29.
7. Kevlar XP—lighter weight resin and KM2 plus fiber combination.
8. Kevlar KM2—enhanced ballistic resistance for armor applications.

The ultraviolet component of sunlight degrades and decomposes Kevlar, a problem known as UV degradation, and so it is rarely used outdoors without protection against sunlight Nevertheless, should a new material be identified that is less expensive, and that is much more flexible than known protective material, the entire glove surface area may be made of the new arrow puncture resistant material.

Figure 4:
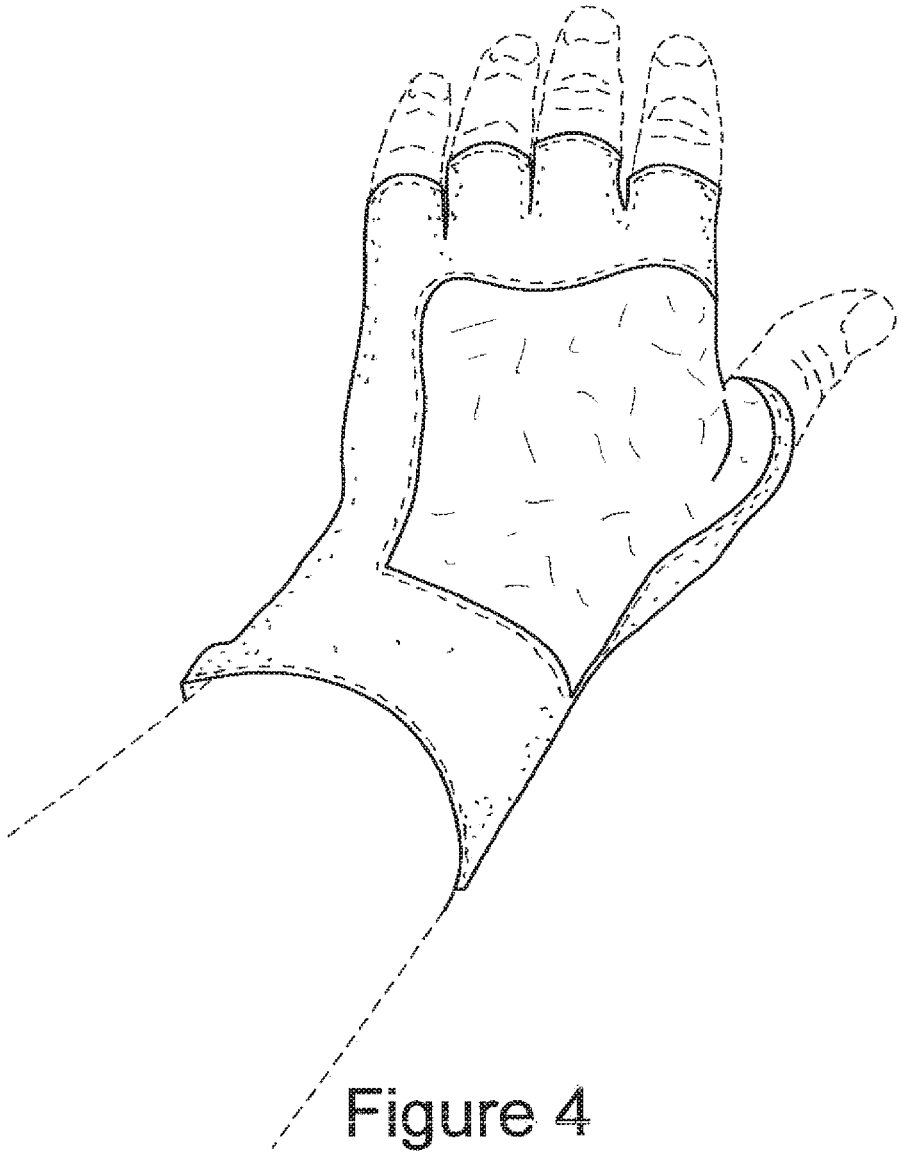
FIG. 4 is a top rear view of the protective glove for archery shooting being worn by an archer according to an embodiment of the present illustrated invention.

FIG. 4 is a top rear view of the protective glove for archery shooting being worn by an archer according to an embodiment of the present illustrated invention.

Figure 5:
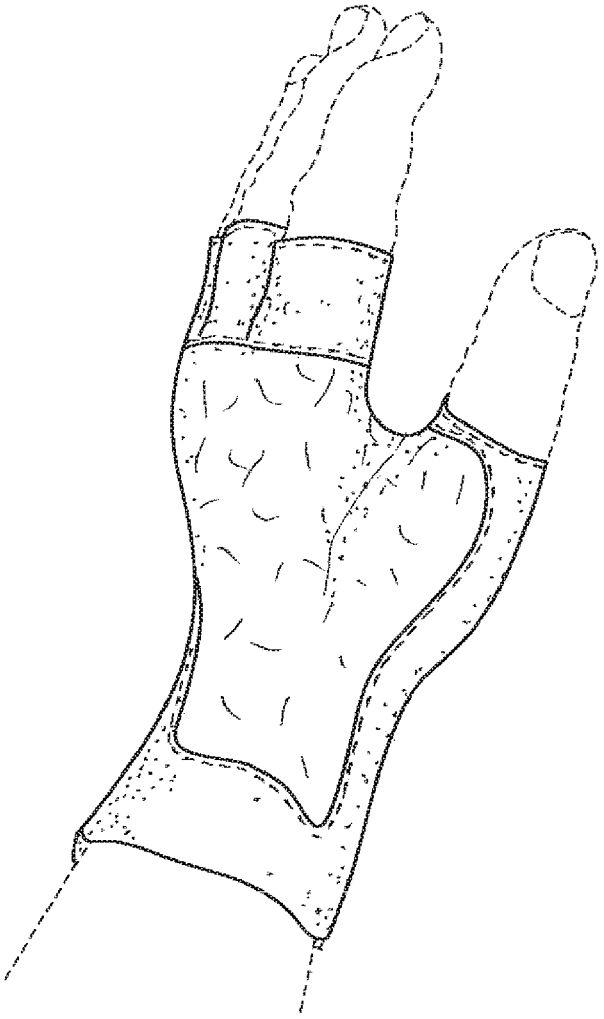
FIG. 5 is a top side view of the protective glove for archery shooting being worn by an archer according to an embodiment of the present illustrated invention.

FIG. 5 is a top side view of the protective glove for archery shooting being worn by an archer according to an embodiment of the present illustrated invention.

Figure 6:
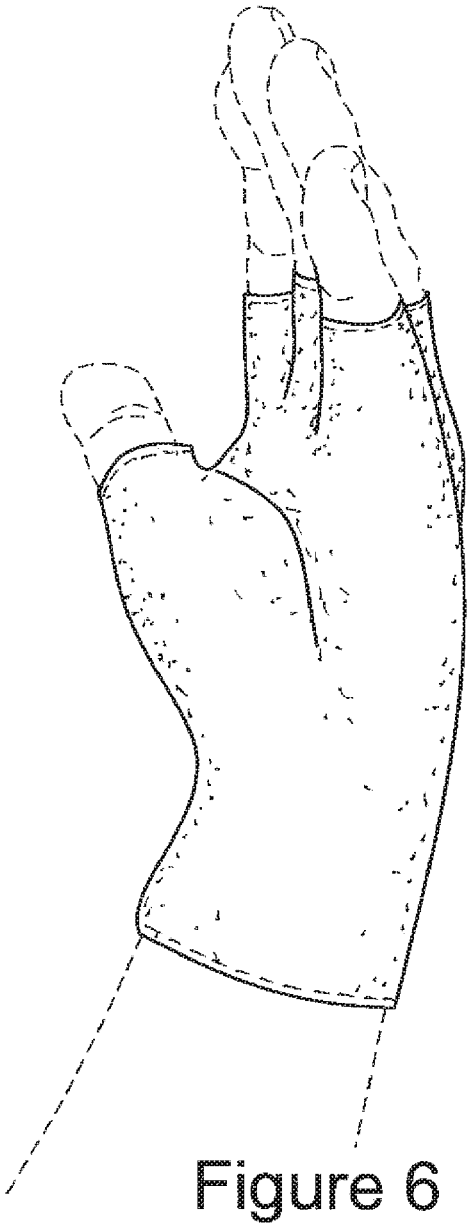
FIG. 6 is a bottom side view of the protective glove for archery shooting being worn by an archer according to an embodiment of the present illustrated invention.

FIG. 6 is a bottom side view of the protective glove for archery shooting being worn by an archer according to an embodiment of the present illustrated invention.

Figure 7:
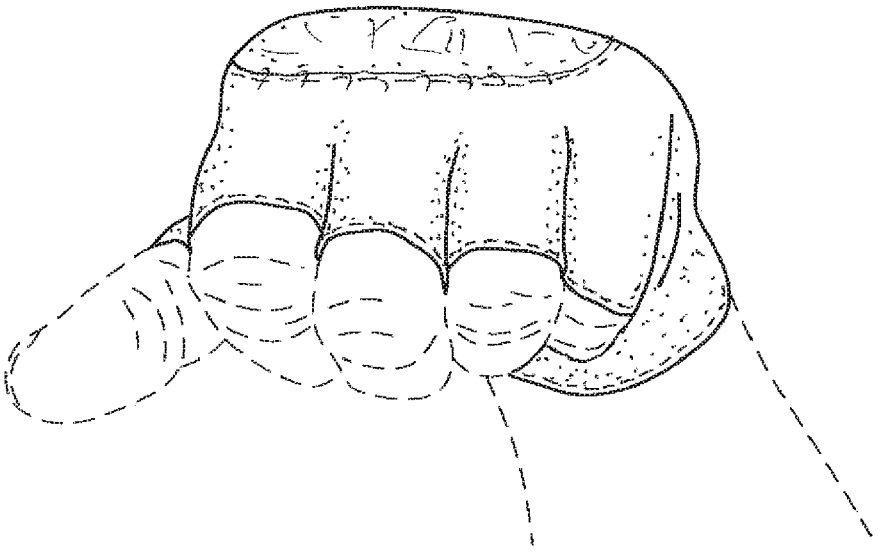
FIG. 7 is a front view with the fingers closed of a user while wearing the protective glove for archery shooting being worn by an archer according to an embodiment of the present illustrated invention.

FIG. 7 is a front view with the fingers closed of a user while wearing the protective glove for archery shooting being worn by an archer according to an embodiment of the present illustrated invention.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although reference has been made to a two or four layer arrow impact resistant area, one skilled in the art will realize after reading the specification that there are other possibilities for the illustrated embodiments of the invention. Specifically, there could be a single layer of a new type of developed material that has all the qualities of all the listed criteria needed to provide the advantages illustrated by the specification and appended drawings. For example, in one embodiment, a single material could be developed or found that has the arrow impact resistance quality and impact power dissipation to both protect the hand from being cut by the arrow and from being excessively hurt from the impact. Additionally, in another embodiment, it is contemplated to use only a single layer of resistant material and one of absorption material, instead of the two of each shown in the illustrated embodiments.

Additionally, in one embodiment, although the figures illustrate only a certain design or placement of the resistant patch 14, wherein the shape of the patch can be most any shape. One skilled in the art will realize that there are an infinite number of shapes that the patch 14 could take while being located on the back of the hand. For example, different shapes could be square, round, oblong, etc. It is also possible to cover the entire back half of the hand. It is even envisioned to cover sides of the hand and fingers in one embodiment.

It is noted, in one embodiment, it is not envisioned to cover the palm of the hand with the protective material known at the present time. The known protective material is more expensive than common leather, cotton cloth, nylon etc., which are used in the common construction of gloves.

It is also noted, in one embodiment, that in the illustrated figures, the protective patch 14 is designed to cover only four knuckles 22, which are illustrated as dashed circles in the drawings. Specifically, the knuckles needed to be covered are the thumb, index, middle and ring finger knuckles; the little finger is not needed to be covered. Although, all knuckles could be covered in other embodiments to accommodate other sizes and shapes of hands.

Furthermore it is noted that although the present embodiments discuss the use of using thread to sew the protective layer or material to the first material of the glove, one skilled in the art will realize that any form of attaching the two materials will be sufficient. For example, gluing, welding, adhering or any other known means of attachment will be sufficient to couple the materials together.

While the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

The invention claimed is:

1. A protective glove comprising:

a flexible first material covering a palm section of the glove, a wrist section of the glove, and at least a knuckle of a thumb of the glove, and knuckles of the fingers of the glove;

a protective section comprising a second material, said protective section covering a first metacarpal of the glove and a second metacarpal of the glove, said protective section extending continuously from the first metacarpal of the glove to the second metacarpal of the glove covering a purlicue of the glove; said protective section not covering at least the palm of the glove;

wherein the second material comprises a puncture-resistant material.

2. The protective glove of claim 1, wherein the first material comprises leather, cotton, nylon, polymers, or silk.

3. The protective glove of claim 1, wherein the second material comprises poly paraphenylene terephthalamide.

4. The protective glove of claim 1, wherein at least one of the fingers of the glove allow the finger of the user to extend from the glove.

5. A protective glove to cover at least a portion of a hand of an archer during shooting of arrows from a bow, comprising:

a) a palm section made of a first material adapted to cover at least the palm of the hand of the user;

b) a back section made of the first material adapted to cover at least a portion of the back of the hand of the user, c) a flexible protective section stitched to the back section of the glove, made of a second material that is more puncture resistant than the first material, wherein the flexible protective section extends laterally from a first metacarpal to at least a second metacarpal of the glove covering a purlicue of the glove.

6. The protective glove of claim 5, wherein the protective section is adapted to extend longitudinally from knuckles of first through the fourth metacarpals to a wrist of the glove.

7. A protective glove comprising:

a flexible first material covering a palm section of the glove, a wrist section of the glove, and a thumb section of the glove, and a plurality of finger sections of the glove;

a protective section comprising a second material comprising a puncture-resistant material, said protective section covering the first metacarpal of the glove and the second metacarpal of the glove, said protective section extending continuously from the first metacarpal of the glove to the second metacarpal of the glove covering a purlicue of the glove;

wherein the protective section is stitched to the flexible first material;

wherein the protective section does not cover the palm section of the glove.

8. The protective glove of claim 7, wherein at least one of the finger section of the glove allow the finger of the user to extend from the glove.

* * * * *